US006224296B1

(12) United States Patent
Fukumori

(10) Patent No.: US 6,224,296 B1
(45) Date of Patent: May 1, 2001

(54) SLIDING DOUBLE PANEL TYPE TRENCH SHORING SYSTEM

(75) Inventor: Kenich Fukumori, Nara (JP)

(73) Assignee: Japan Speed Shore Co., Ltd. (JP)

( * ) Notice: Subject to any disclaimer, the term of this patent is extended or adjusted under 35 U.S.C. 154(b) by 0 days.

(21) Appl. No.: 09/112,310

(22) Filed: Jul. 9, 1998

(30) Foreign Application Priority Data

Jul. 9, 1997 (JP) ..... 9-219701
May 22, 1998 (JP) ..... 10-141846

(51) Int. Cl.[7] ..... E02D 17/00; E02D 29/02

(52) U.S. Cl. ..... 405/282; 405/283; 405/272; 405/273

(58) Field of Search ..... 405/282, 283, 405/272, 273

(56) References Cited

U.S. PATENT DOCUMENTS 3,999,789 * 12/1976 Maurits et al. ..... 292/34
4,274,763 * 6/1981 Krings ..... 405/282
4,366,984 * 1/1983 Klueting et al. ..... 297/379
4,607,200 * 8/1986 Zimmerman ..... 318/484
4,993,877 * 2/1991 Beamer ..... 405/282
5,310,289 * 5/1994 Hess ..... 405/282
5,503,504 * 4/1996 Hess et al. ..... 405/282
5,513,555 * 5/1996 Plank et al. ..... 405/282
5,743,593 * 4/1998 Vogt ..... 297/238
5,810,434 * 9/1998 Thompson et al. ..... 297/188.19
5,873,631 * 2/1999 Peck et al. ..... 297/378.11

FOREIGN PATENT DOCUMENTS

2257881 * 11/1972 (DE) ..... 405/282
2930796 * 2/1981 (DE) ..... 405/292
77421 6/1981 (JP) .
336723 12/1994 (JP) .
15833 3/1995 (JP) .
144267 6/1996 (JP) .

OTHER PUBLICATIONS

Suzuki, Office Action, Japanese Patent Office, Mar. 9, 1999, Japan.
Ito, Office Action, Japanese Patent Office, Jul. 13, 1999, Japan.
Inaoka, Office Action, Japanese Patent Office, Feb. 8, 2000, Japan.

* cited by examiner

*Primary Examiner*—Thomas B. Will
*Assistant Examiner*—Alexandra K. Pechhold
(74) *Attorney, Agent, or Firm*—Andrews & Kurth L.L.P.; Anthony F. Matheny

(57) ABSTRACT

A trench shoring system using panels as shoring walls to prevent possible collapse of natural ground walls of trenches in trenches such as for burying pipes underground, having a sliding panels type trench shoring system that offers increased safety during the job, and higher job efficiency.

13 Claims, 11 Drawing Sheets

SLIDING DOUBLE PANEL TYPE TRENCH SHORING SYSTEM

BACKGROUND OF THE INVENTION

1. Field of the Invention

The invention is directed to a trench shoring system for use in trenches such as those for burying pipes underground, and particularly, a trench shoring system which utilizes double sliding panels to prevent collapse of the walls of the trench.

2. Description of Related Art

Currently, there exists a trench shoring system using panels to prevent soil collapse. In this system, two or more struts are affixed to slide rails. Two sets of this ladder-like structure are assembled. First, one set is driven vertically into the trench, then one end of each of two panels are fitted onto the slide rails, and then the other ladder-like structure is fitted onto the other end of the two panels. As the section of the trench inside this box-like structure is dug, the panels and the slide rails are driven in turns, and this step is repeated continuously until the panels reach a specified depth.

Concerning this system, panels are used in two levels, upper and lower. The lower panel is called the edged panel and the upper panel is called the extension panel. If the depth of the trench exceeds 5 m, double rails, which are slide rails with double grooves for inserting panels into, are also used.

With this conventional trench shoring system, as illustrated in FIGS. 5–9, after a preliminary ditch is dug, the front slide rails are driven in at the front end of the trench. Then two edged panels, which are panels with a pointed edge along the bottom, are fitted at one end into the front slide rails and driven in. After that, at the other end of the trench, back slide rails are fitted onto the other end of the edged panels and driven into the trench. This results, at the end, in a safe, box-like trench shoring structure. However, during the assembly of this structure, when the edged panels are being fitted into the front slide rails and driven in, or when the back slide rails are being driven into the free end of the edged panels, the work may be dangerous and difficult.

Also, similarly, after the back slide rails are driven in, when the front slide rails are being driven deeper into the trench floor, or when the extension panels are being fitted into the slide rails after the edged panels have been driven deeper into the trench floor, the work may be difficult.

Additionally, while digging to the desired depth, when driving in the inner panels and slide rails by pushing from on top with the bucket of an excavator, especially when the slide rails are double rails, there is the possibility of the problem of the outer panels, the top of which should be at ground level (GL) to stabilize the natural ground walls of trenches, falling or sinking further into the ground due to the vibration caused by the driving in of the slide rails.

This invention addresses the problems detailed above, and as a trench shoring system that uses panels as shoring walls to prevent the possible collapse of natural ground walls of trenches when burying pipes underground, it not only prevents danger but also, compared to conventional technology, presents a remarkable improvement injob efficiency. Additionally, this invention offers shoring panels which contain mechanisms that prevent the two sliding panels from sliding beyond the specified sliding depth.

SUMMARY OF INVENTION

In accordance with the invention the foregoing advantages have been achieved through the present trench shoring system for preventing possible falling of natural ground walls of trenches, comprising: a pair of outer panels, each outer panel having inner and outer wall surfaces and upper and lower portions; a pair of inner panels, each inner panel having inner and outer wall surfaces and upper and lower portions, the pair of inner panels being coupled together by at least one strut, one pair of panels being disposed for vertical sliding movement along a wall surface of the other pair of panels; and at least one stopping member associated with at least one pair of panels for preventing the one pair of panels from sliding past a desired position with respect to the other pair of panels whereby the lower portions of one pair of panels and the upper portions of other pair of panels define an overlapping area.

A further feature of the trench shoring system is that the inner panels may be coupled together by at least two struts. Another feature of the trench shoring system is that the pair of outer panels may be coupled together at the upper portions of the outer panels by at least one strut thereby providing a space between the pair of outer panels to receive the inner panels. An additional feature of the trench shoring system is that at least one of the pairs of panels may include guides thereby providing vertical sliding movement of the one pair of panels with respect to the other pair of panels. A further feature of the trench shoring system is that each of the at least one strut may be freely adjustable lengthwise. Another feature of the trench shoring system is that the outer panels may include a pair of stopping members. An additional feature of the trench shoring system is that the stopping member may include: at least one pendulum latch in contact with one of the pairs of panels, and a portion of the pendulum latch defines a projection; and at least one collision piece is in contact with one of the pairs of panels and contacts the projection when one pair of panels slides down to a desired position with respect to the other pair of panels, thereby preventing the one pair of panels form sliding down further with respect to the other pair of panels. A further feature of the trench shoring system is that the pendulum latch may be swingably supported at a position off from the center of gravity by a supporting axis thereby allowing the pendulum latch to rotate by its own weight, and includes a stopper that limits the rotation of the pendulum latch so that the pendulum latch stops with a portion thereof projecting from one of the pairs of panels. Another feature of the trench shoring system is that the pendulum latch may be swingably supported by a supporting axis, and includes an elastic energizing means thereby enabling the pendulum latch to rotate until a portion of the pendulum latch projects from one of the pairs of panels, and a stopper thereby limiting the rotation of the pendulum latch.

In accordance with the invention, the foregoing advantages have also been achieved through the present set of trench shoring panels comprising: two panels disposed for vertical sliding movement with respect to each other thereby providing shoring walls; at least one pendulum latch contacting one of the two panels, wherein a portion of the pendulum latch defines a projection; and at least one collision piece on the other panel which contacts the projection of the pendulum latch when the two panels slide to a desired position with respect to each other.

A further feature of the trench shoring panel assembly is that the set of trench shoring panels may include double slide rails having two parallel grooves, the two panels disposed for sliding movement of the two panels with respect to each other within the grooves.

In accordance with the invention, the foregoing advantages have also been achieved through the present stopping device comprising a pendulum latch wherein a portion of the pendulum latch defines a projection, the pendulum latch being swingably supported by a supporting axis at a position off from the center of gravity of the pendulum latch and rotated by the pendulum latch's own weight or an energizing force generated by an elastic energizing means; and a stopper that limits the rotation of the pendulum latch.

Figure 1:
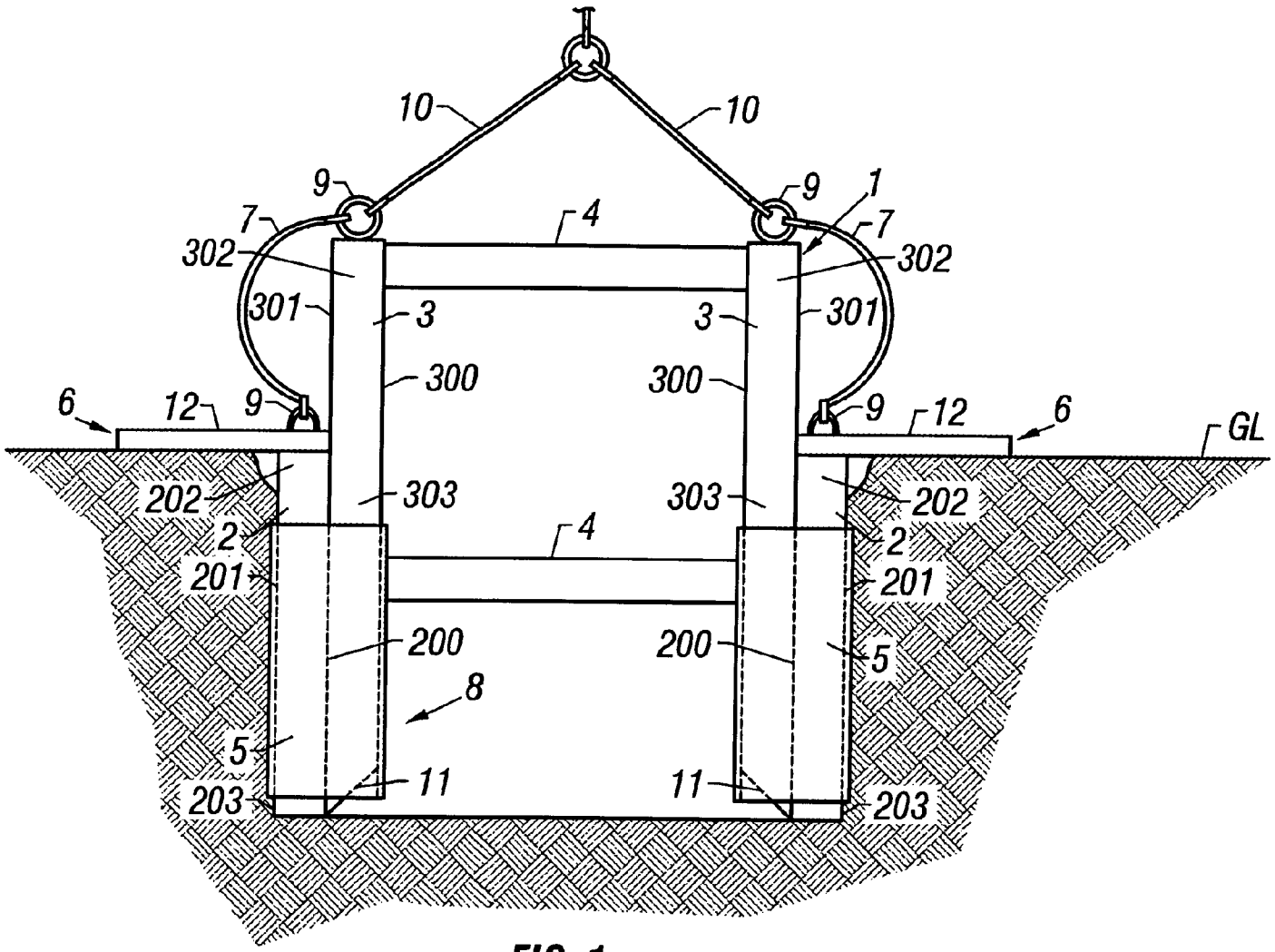
FIG. 1 is a front view of one embodiment of the invention being installed into a trench before extension.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims and equivalents thereof.

DETAILED DESCRIPTION AND SPECIFIC EMBODIMENTS

The sliding double panel type trench shoring system, or shoring system, of the present invention is easier and less expensive to install and remove compared to previous shoring systems. Because the inner panels are assembled together and the outer panels are fitted onto the inner panels assembly before the start of the excavation or at the assembly plant, the shoring system according to this invention can be lifted up in its entire assembled state and lowered into a trench by a crane or a backhoe, making assembling the system in the trench unnecessary, and unlike conventional shoring systems using panels, where the work may be dangerous and difficult when the edged panels are being fitted into the front slide rails and driven in, or when the back slide rails are being driven into the free end of the edged panels, this shoring system offers a high degree of safety.

Also, the job of installing and removing the shoring is simple and fast. When removing the shoring system from the trench, at first only the inner panels assembly is lifted up until it is at approximately the same height as the outer panels, and then both the inner and outer panels are lifted up together out of the trench, thus making the job of removing the shoring system from the trench extremely easy. Also, the crane or backhoe used for the removal of the system from the trench has a smaller load to lift than with conventional shoring systems. Consequently, since a crane or backhoe with a smaller capacity can be used, the cost of removing this shoring system can be lower than with conventional shoring systems, and the job efficiency is higher. In addition, by this invention, a panel stopping device which is able to reliably stop the sliding of panels beyond a specified position can be offered.

Concerning this invention, before the start of the excavation or while in the assembly plant, in order to provide the stability of a box-shape to the outer panels, the inner panels which are coupled by struts are made to slide as a single unit on guide rails that are fixed to the left and right of the outer panels. The outer panels may be coupled at the upper portions by struts to support against the soil pressure acting on the outer panels. The single unit sliding panels shoring system may then be lowered into a preliminary trench, and then, as the excavation proceeds, the inner panels are made to slide down following the receding trench floor, so that a stable box-shape inner panel assembly can be driven in to any desired depth within the limits of the maximum trench depth allowed by this shoring system.

Concerning this invention, within the limits of the maximum trench depth allowed by this shoring system, the struts of the inner panels also finction as struts of the outer panels, and therefore provide additional support against the soil pressure acting on the outer panels. In other words, when the excavation is shallow, the inner panels slide down only a little, and the overlap of the inner and outer panels is large. Therefore, the struts on the inner panels additionally support the upper portion of the outer panels. When the excavation is deep, the inner panels slide down a lot, but even though the overlap of the inner and outer panels is small, the struts on the inner panels continue to support the lower portion of the outer panels, thus making it unnecessary to have struts on the lower portions the outer panels.

The inner panels assembly functions as struts for the outer panels, thus making it unnecessary for the outer panels to be coupled together at least at the lower portions. In other words, this invention features a set of outer panels with upper struts; a set of inner panels, assembled by being coupled on the left and right with struts, which slide only vertically in the space in between the two outer panels; and at least one stopper that stops the sliding of the bottom of the outer panels and the top of the inner panels at a certain point, so that the panels stay within the limits of the maximum trench depth allowed by this shoring system. Preferably, the struts are freely adjustable lengthwise, thereby permitting the struts to be applied to various trench widths.

One specific embodiment of the sliding double panel type trench shoring system, wherein panels designed to prevent possible falling of natural ground walls of trenches excavated to bury pipes or the like in the underground are used as shoring walls, includes a pair of outer panels; a pair of inner panels that are coupled together by struts and slide vertically along the inside of the outer panels; and a stopping device that prevents the inner panels from sliding down further with respect to the outer panels so that the overlap of the lower portions of outer panels with the upper portions of inner panels will not be below the specified dimension when the inner panels slide downward with respect to the outer panels.

A further feature of the sliding double panel type trench shoring system is that the inner panels may be coupled together by two or more struts and function as struts for all or part of the pair of outer panels depending on the sliding positions of inner panels with respect to the outer panels. Another feature of the sliding double panel type trench shoring system is that the pair of outer panels may be coupled together at the upper portions by struts in such a manner that the spacing required for a pair of inner panels to slide is maintained. An additional feature of the sliding double panel type trench shoring system is that the outer or inner panels may include guides that guide sliding inner panels with respect to outer panels so that the inner panels slide vertically with respect to the outer panels. Still a further feature of the sliding double panel type trench shoring system is that each strut may be freely adjustable lengthwise. A further feature of the sliding double panel type trench shoring system is that the outer panels may, at the upper portions, include a pair of retaining means that prevent the outer panels from dropping below the desired position of an excavated trench. Another feature of the sliding double panel type trench shoring system is that the inner or outer panels include at least one stopping member, the stopping member having a pendulum latch that is provided on either outer panels or inner panels, part of the pendulum latch projecting to the other sides of either the outer panels or inner panels when rotated; and a collision piece that is provided on the other sides of either the outer panels or inner panels; and hits against the projection of the pendulum latch when the inner panels slide down to the specified position with respect to the outer panels whereby the inner panels are disabled to slide down any further with respect to the outer panels. Still another feature of the sliding double panel type trench shoring system is that the pendulum latch may be swingably supported at a position off from the center of gravity by a supporting axis; rotates by its own weight, and has a stopper that limits the rotation of the pendulum latch so that the pendulum latch stops with part thereof projecting from the outer or inner panels An additional feature of the sliding double panel type trench shoring system is that the pendulum latch may be swingably supported by a supporting axis; may be provided with an elastic energizing means so as to enable the pendulum latch to rotate until part thereof projects from the outer or inner panels; and may include a stopper that limits the rotation of the pendulum latch in the projected condition.

Another embodiment of the invention is directed to a trench shoring panel assembly, wherein the trench shoring panel assembly includes two panels that form shoring walls by sliding in a vertical direction; one or more pendulum latches that are provided on one of the two panels, part of the pendulum latch(es) projecting to the other panel side by rotating; and one or more collision pieces that are provided on the other of the two panels, and hit(s) against the projection(s) of the pendulum latch(es) when the two panels slide to the specified position, to thereby prevent the two panels from sliding down any further.

A further feature of the trench shoring panel assembly is that the two panels slide with the side edges thereof being guided by double slide rails having two parallel grooves.

Still another embodiment of the invention is directed to a stopping device that can be mounted on panels forming shoring walls, or on double sliding rails; and is characterized in having a pendulum latch of which part projects when the pendulum latch rotates, the pendulum latch being swingably supported by a supporting axis at a position off from the center of gravity and rotated by its own weight or an energizing force generated by an elastic energizing means including rubber and spring in such a manner that part of the pendulum latch projects; and a stopper which limits the rotation of the pendulum latch so as to stop in the rotated condition.

According to the design described above, the stopping device is applicable to shoring panels and double slide rails, and when the panel slides, the pendulum latch which projects out reliably stops the sliding at a specified position.

Referring now to FIGS. 1–4, broadly, the shoring system 8 includes the inner panels assembly 1 and a pair of outer panels 2. The inner panels assembly 1 includes a pair of inner panels 3 coupled together by four struts 4 or inner panel struts 4', two struts 4 at each of the upper and lower portions of the inner panels 3. The outer panels 2 include guide rails 5 at both the left and right ends of the outer panels 2 into which the inner panels 3 can be fitted such that the inner panels assembly 1 is able to slide vertically with respect to the outer panels 2. The inner panels assembly 1 and the outer panels 2 are assembled together before the start of the excavation and, at the excavation site, the shoring system 8 is lowered into the trench. Following lowering the shoring system 8 into the preliminary trench, if the digging is done in between the inner panels 3, the inner panels assembly 1 will slide downwards. The sliding of the inner panels assembly 1 should be limited by wires 7. The outer panels 2 are suspended by hangers 6 set in the upper portions of each of the outer panels 2 so that they will not fall into the trench.

The sliding panels shoring system 8 is completely assembled, before the start of the excavation or while in the assembly plant, when the inner panels assembly 1 and the outer panels 2 are made into a single unit by sliding the guide rails 5, which are fixed on both ends of the outer panels 2, along both ends of the inner panels 3.

After the completely assembled sliding panels shoring system 8 described above is lifted up with a crane or backhoe, and is lowered and driven into the preliminary trench with a crane or backhoe, the outer panels 2 of the sliding panels shoring system 8 are suspended at the desired level by hangers 6 fixed to the upper portion of the outer panels 2.

If digging the trenches is done within the area boxed in by the sliding panels shoring system 8 suspended at the specified level as described above, the inner panels assembly 1 can be made to slide downward easily, until the specified depth, which is within the maximum depth allowed by the sliding panels shoring system 8.

As stated above, with trench shoring systems using panels, the installing of the slide rails involves the job of assembling the system in the trench and driving in materials at the job site, and in many cases this further destabilizes the already unstable soil of the natural ground walls of the trench during the excavation. This invention, which is a trench shoring system using panels as shoring walls to prevent possible collapse of natural ground walls of trenches when burying pipes underground, offers the following methods, in order to solve these problems.

Figure 3:
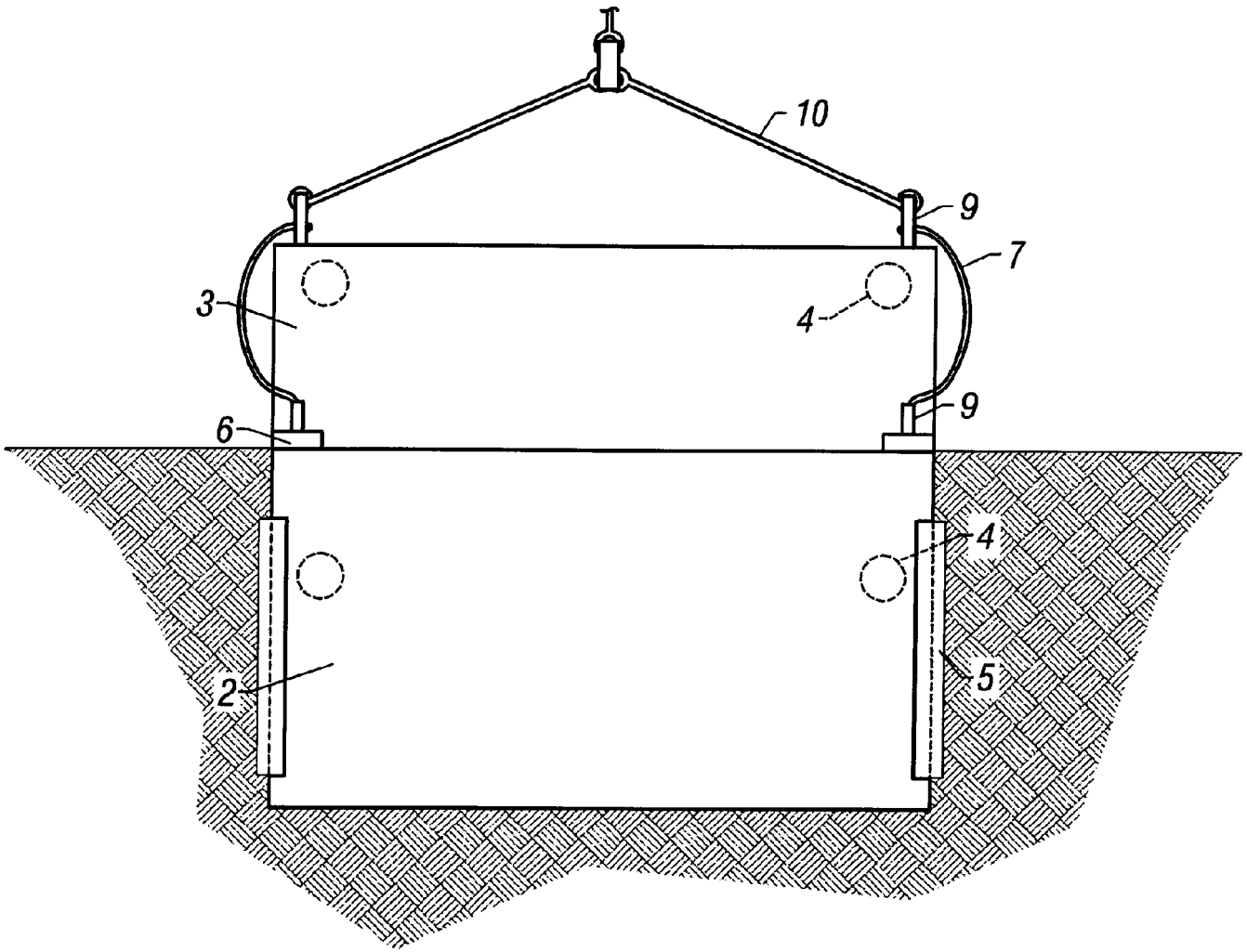
FIG. 3 is a side view of the embodiment shown in FIG. 1 being installed into a trench before extension.

As shown in FIG. 1, a front view diagram of one embodiment of this invention, the sliding panels shoring system 8 has been lowered and driven into a preliminary trench. FIG. 3 is a side view diagram of the same.

Figure 2:
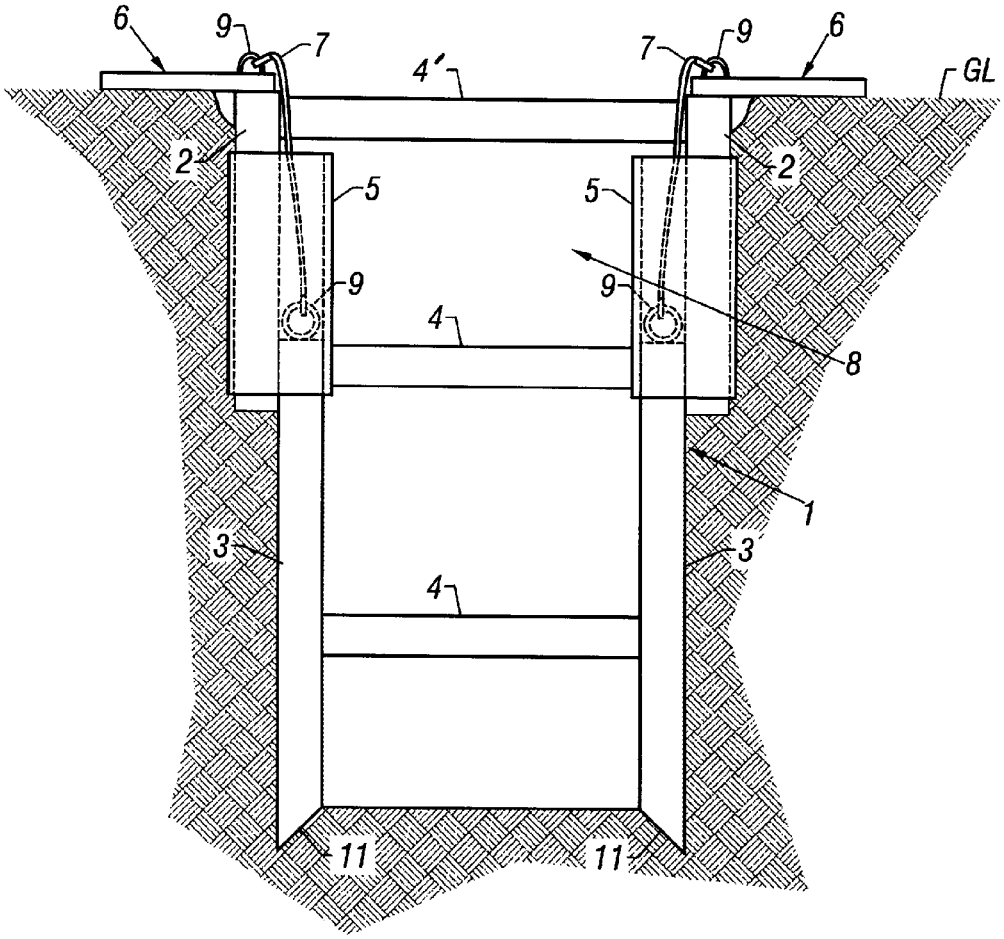
FIG. 2 is a front view of the embodiment shown in FIG. 1 being installed into a trench after extension.
Figure 4:
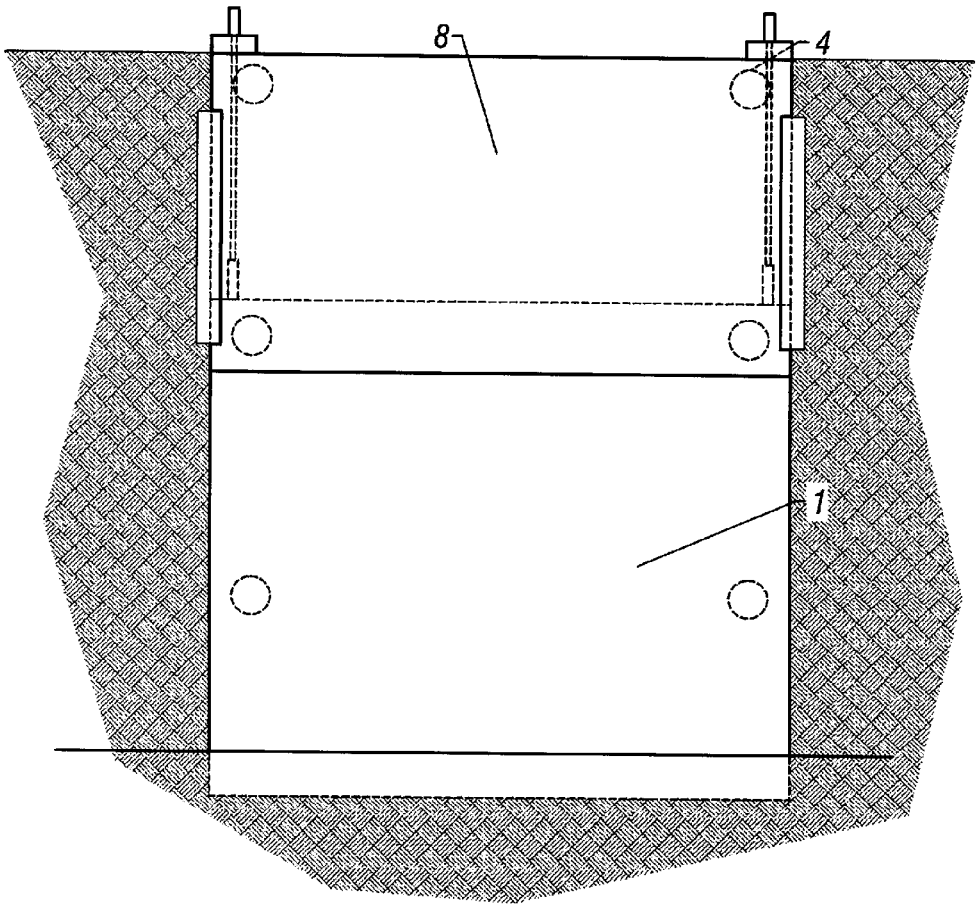
FIG. 4 is a side view of the embodiment shown in FIG. 1 being installed into a trench after extension.
Figure 5:
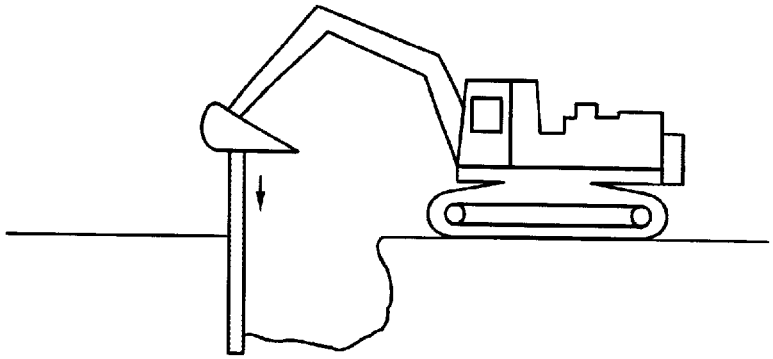
FIG. 5 (Prior Art)
FIG. 5 is a side view of a prior art method of installing shoring systems illustrating the step of driving in front slide rails.
Figure 6:
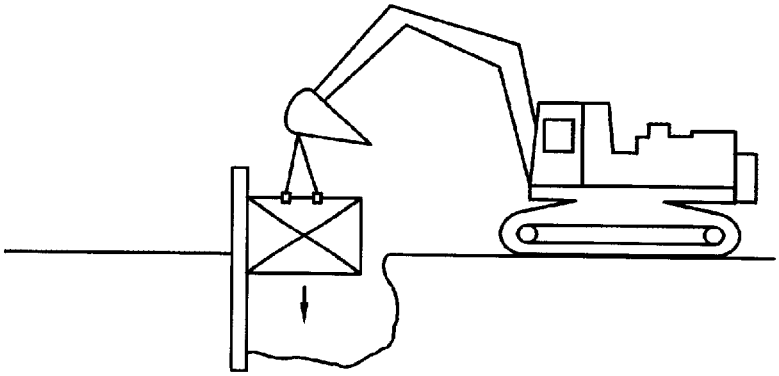
FIG. 6 (Prior Art)
FIG. 6 is a side view of the method of installing shoring systems shown in FIG. 5 illustrating the step of inserting edged panels into front slide rails.
Figure 7:
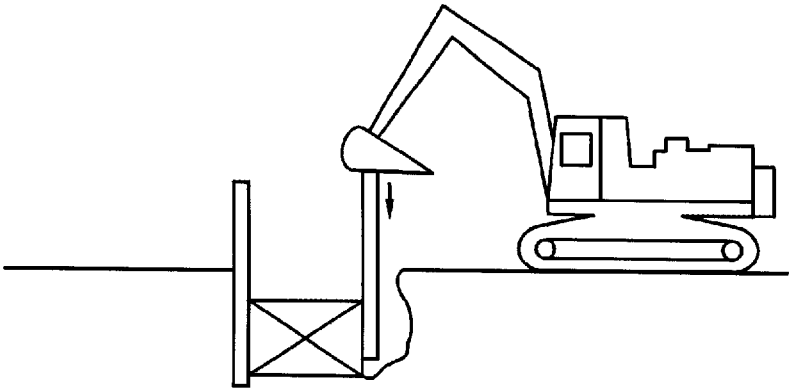
FIG. 7 (Prior Art)
FIG. 7 is a side view of the method of installing shoring systems shown in FIG. 5 illustrating the step of driving in back slide rails.
Figure 8:
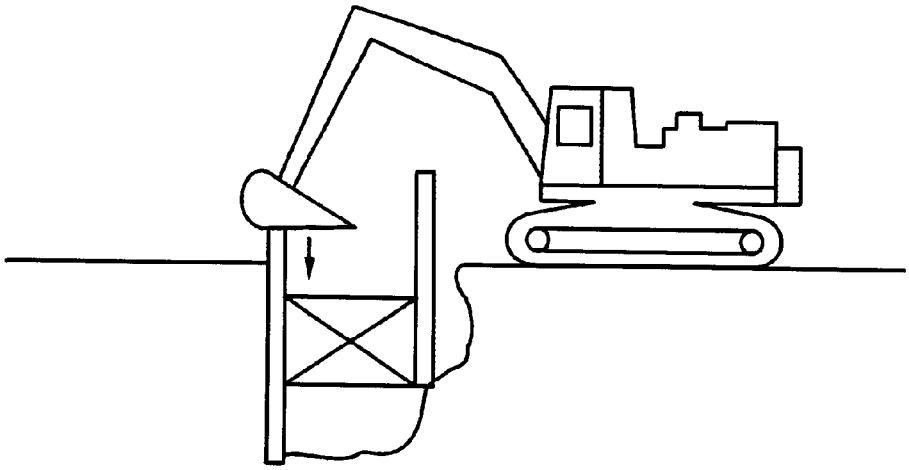
FIG. 8 (Prior Art)
FIG. 8 is a side view of the method of installing shoring systems shown in FIG. 5 illustrating the step of driving in front slide rails deeper after having driven in the back slide rails.
Figure 9:
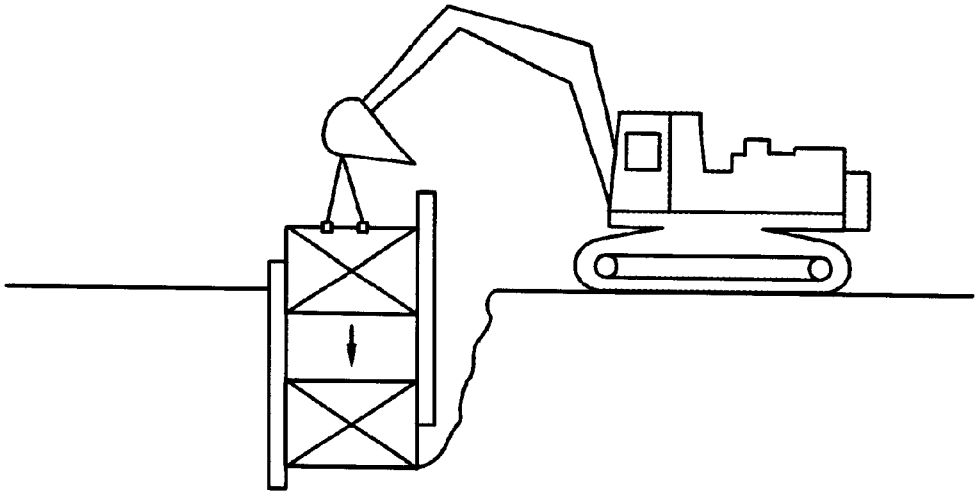
FIG. 9 (Prior Art)
FIG. 9 is a side view of the method of installing shoring systems shown in FIG. 5 illustrating the step of inserting extension panels.

FIG. 2 is a front view diagram, in which, after the shoring system 8 has been driven in, the trench has been excavated further and the inner panels assembly 1 has been made to slide down deeper. FIG. 4 is a side view diagram of the same.

As illustrated in FIGS. 1–4, the sliding panels shoring system according to this invention consists of inner panels assembly 1 having inner panels 3 and outer panels 2. The inner panels 3, include an inner wall 300, an outer wall 301, an upper portion 302, and a lower portion 303. The outer panels 2 include an inner wall 200, an outer wall 201, an upper portion 202, and a lower portion 203. The inner panels 3 should be coupled by four struts 4, two each at the upper and lower ends, and a safe space between the left and right inner panels is secured. Also, hangers 6 should be set in the upper portions of each of the outer panels 2. Hangers 6 prevent the outer panels 2 from entering deeper into the trench than is necessary. To realize this function, the hangers 6 may also include arms 12. The arms 12 preferably project out approximately perpendicular from both ends of the outer panels 2, and are designed to rest on the surface of the ground (GL). The bottom section of the inner panels 3 are preferably fitted with edges 11 to make driving them down easier. The two ends of the outer panels 2 are preferably fitted with guide rails 5 into which it is possible to slide in the two ends of the inner panels 3.

As stated above, before the start of the excavation or while in the assembly plant, the sliding panels shoring system 8 is completed as the inner panels assembly 1 and the outer panels 2 are made into a single unit by sliding the guide rails 5, which are fixed on both ends of the outer panels 2, along both ends of the inner panels 3. The sliding panels shoring system 8 described above may then be transported to the excavation site, lifted up with a lifting devices such as a crane or backhoe, and lowered and driven into the preliminary trench. The outer panels 2 of the sliding panels shoring system 8 are suspended at the desired level by hangers 6 fixed to the upper portion of the outer panels 2.

In this example, the sliding panels shoring system 8 is suspended at the desired level by hangers 6, but if the soil at the excavation site is unstable and it is difficult to dig deeply at one time, the digging can be done in the boxed in area within the inner panels assembly 1 and as the digging gets deeper the entire sliding panels shoring system 8 is driven down deeper until the arms of the hangers 6 fixed to the outer panels 2 come into contact with the surface of the ground (GL).

When the sliding panels shoring system 8 is suspended at the specified level as described above, the digging within the boxed in area can also be done with backhoes, for example.

When the outer panels 2 are suspended at the specified level, and the inner panels 3 are driven to slide down even deeper, struts 4', or outer panel struts 4' may be fixed at the upper portion of the outer panels 2.

The inner panels assembly 1 may then be slid down to the specified depth, which is within the maximum depth allowed by the sliding panels shoring system.

Still with reference to FIGS. 1–4, rings 9 are fixed at arbitrary locations at the upper portions of the inner panels 3 and outer panels 2, by connecting each ring 9 on the inner panels 3 to the corresponding ring 9 on the outer panels 2 with a wire 7 of a specified length which act as a stopper which prevents the inner panels assembly 1 from sliding down deeper, past the maximum depth allowed by the sliding panels shoring system. Accordingly, the overlap of the lower portion of the outer panels 2 and the upper portion of the inner panels 3 will not be below the specified dimension.

After pipe-laying or other necessary work is completed in the trench, the inner panels assembly 1 is lifted upward and allowed to slide up until it is at its original position. Soil is partially refilled into the trench until just below the bottom surface of the sliding panels shoring system 8. Using a crane, backhoe or other lifting device, the sliding panels shoring system 8 is lifted up out of the trench little by little or, if the natural ground walls of the trench are stable, in one go, and then the trench is refilled completely.

According to the above description of the sliding panels shoring system 8 of this invention, by assembling the outer panels and the inner panels assembly into a single unit, transporting them in this mutually stable state to the excavation site, lowering them into a preliminary trench, and sliding the inner panels assembly downwards little by little as the digging is done within the sliding panels shoring system, the stable box-shaped inner panels assembly can be driven in to the desired depth. Therefore, unlike shoring systems using conventional panels, as when the edged panels are being fitted into the front slide rails and driven in, or when the back slide rails are being, driven into the free end of the edged panels, the work is not dangerous and difficult when using this sliding panels shoring system.

Also, similarly, unlike conventional shoring systems, as when the front slide rails are being driven deeper into the trench floor after the back slide rails are driven in, or when the extension panels are being fitted into the slide rails after the edged panels have been driven deeper into the trench floor, the work is not dangerous and difficult when using this sliding panels shoring system 8.

Also, with conventional panel shoring systems, while digging to the desired depth, when driving in the inner panels and slide rails by pushing from on top with the bucket of an excavator, especially when the slide rails are double rails, there is the possibility of the problem of the outer panels, the top of which should be at ground level (GL) to stabilize the natural ground walls of trenches, falling or sinking further into the ground due to the vibration caused by the driving in of the slide rails. However, with the sliding panels shoring system according to this application form of this invention, this problem is eliminated, and job efficiency can be substantially increased.

Additionally, with this sliding panels shoring system according to this invention, when removing the shoring system from the trench, at first only the inner panels assembly is lifted up until it is at approximately the same height as the outer panels, and then both the inner and outer panels are lifted up together out of the trench, thus making the job of removing the shoring system from the trench extremely easy. Also, the crane or backhoe used for the removal of the system from the trench has a smaller load to lift than with conventional shoring systems. Consequently, since a crane or backhoe with a smaller capacity can be used, the cost of removing this shoring system can be lower than with conventional shoring systems and it can be used even at job sites that are even narrower and spatially confined than ones at which conventional panel shoring systems can be used.

Figure 10:
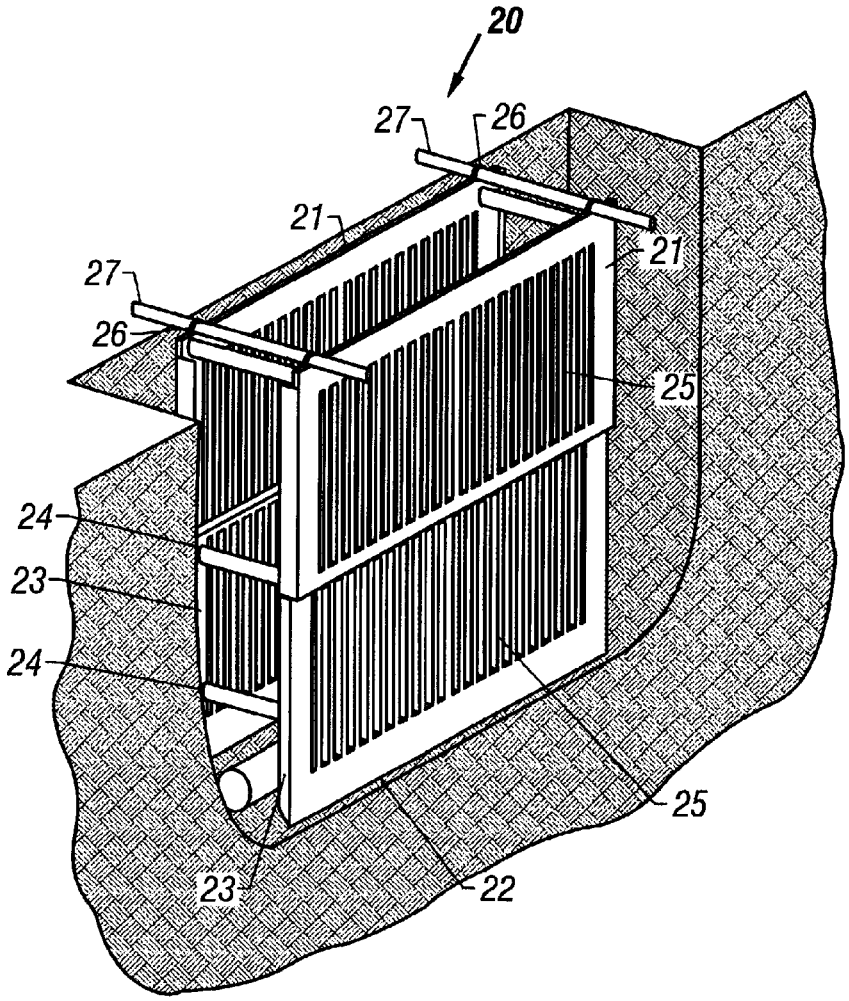
FIG. 10 is a three-dimensional image of one embodiment of the sliding panels of the present invention.

FIG. 10 is a three-dimensional image of one embodiment of a sliding panels shoring system of the invention. The shoring system 20 according to this embodiment also features a set of outer panels 21 and inner panels assembly 22. The inner panels assembly 22 consists of inner panels 23 and four struts 24 which connect between the inner panels 23. Concerning both the outer panels 21 and the inner panels 23, the frames are made using square pipes, and aluminum wave sheets 25, for example, are fitted in.

In the shoring system of this embodiment, rings 26 are fixed at the upper ends of the outer panels 21. Retaining members 27, such as pipes, are inserted into the rings 26, and the shoring system 20 is capable of being suspended by the hanging of both ends of each retaining member 27 on the surface of the ground (GL). In other words, in this embodiment, a suspension device is composed of the rings 26 and the retaining members 27.

Figure 11:
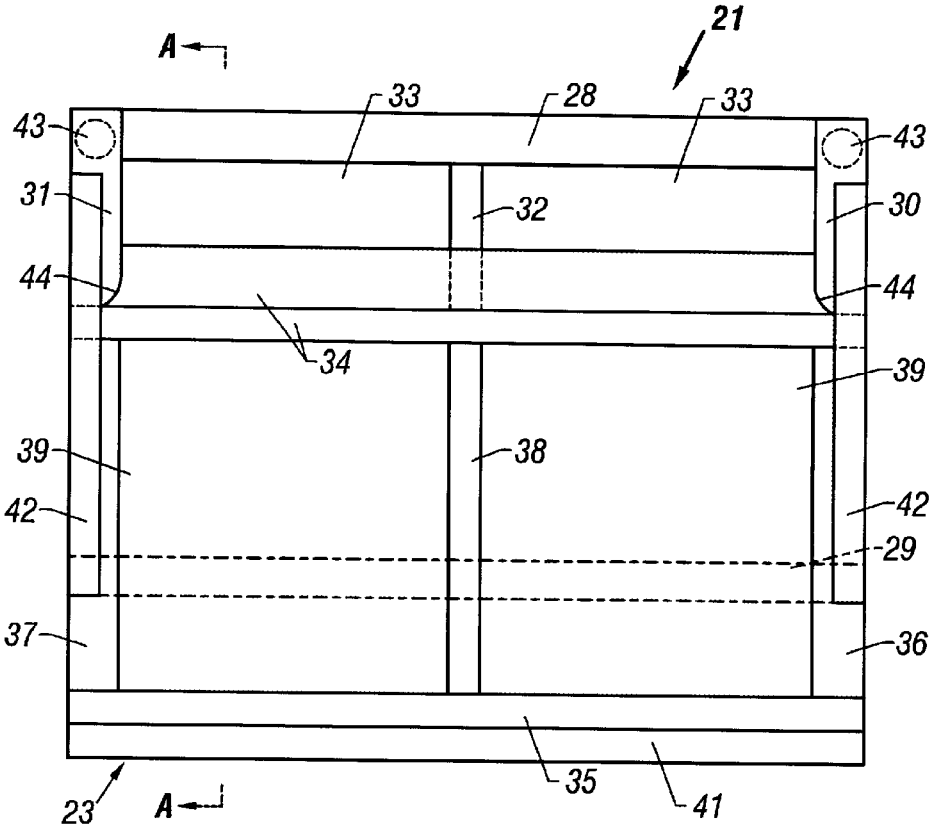
FIG. 11 is a side view of another embodiment of the sliding panels of the present invention.

FIG. 11 shows a view of an inner panel 23 and an outer panel 21 on one side as seen from inside the inner panels assembly 22.

Using FIG. 11 as a reference, the frames assembly of the outer panels 21 consists of the upper horizontal frames 28, the lower horizontal frames 29, the right vertical frames 30, the left vertical frames 31 and the center vertical frames 32. Each of the frames 28, 29, 30, 31, 32 is composed of, for example, steel pipes. Aluminum wave sheets (panels) 33, for example, may be fitted in the spaces enclosed by each of the frames 28, 29, 30, 31, 32.

Similarly to the outer panels 21, the frames assembly of the inner panels 23 include the upper horizontal frames 34, the lower horizontal frames 35, the right vertical frames 36, the left vertical frames 37 and the center vertical frames 38. Wave sheets (panels) 39, preferably constructed out of aluminum, may be fitted in the spaces enclosed by each of the frames 34, 35, 36, 37, 38. Additionally, at the bottom of the lower horizontal frames 35 situated at the lower end of the inner panels 23, knife-edged frames 41, or side edges, with knife-edges at the bottom are preferably secured by, for example, welding. The knife-edged frames 41 facilitate the vertical sliding movement of the inner panels 23. The outer panels 21, may also include knife-edged frames 41 similar to the inner panels 23.

Sliding guides 42 are fitted to the right vertical frames 30 and the left vertical frames 31 of the outer panels 21. The sliding guides 42 have a L-shaped cross-section in order to hold the right vertical frames 36 and the left vertical frames 37 of the inner panels 23 when the outer panels 21 are assembled onto the inner panels 23. Due to the sliding guides 42, the inner panels 23 (the inner panels assembly 22) slide vertically with respect to the outer panels 21. Preferably, the sliding guides 42 are fixed to the outer panels 21 but may, alternatively, be fixed to the inner panels 23 thereby holding the outer panels 21. Also, the cross-section of the sliding guides 42 is not to be limited to a L-shape, but can be a channel-shape or a T-shape, or a vertically long slit which holds a T-shaped projection. To summarize, any cross-section shape that guides the vertical sliding of the inner panels 23 with respect to the outer panels 21 is acceptable.

The inner panels 23 are designed such that struts 43 can be fixed to both right and left sides of the upper portions of the outer panels 21 even after the entire shoring system has been assembled. Thus, the right and left sides of the upper portions of the inner panels 23 have cutout sections 44 so that the inner panels do not collide with the struts 43 in the right and left sides of the upper portions of the outer panels 21. This has the advantage of making possible the installation of struts 43 on the outer panels 21 after the outer panels 21 have been fitted onto the inner panels assembly 22.

Figure 12:
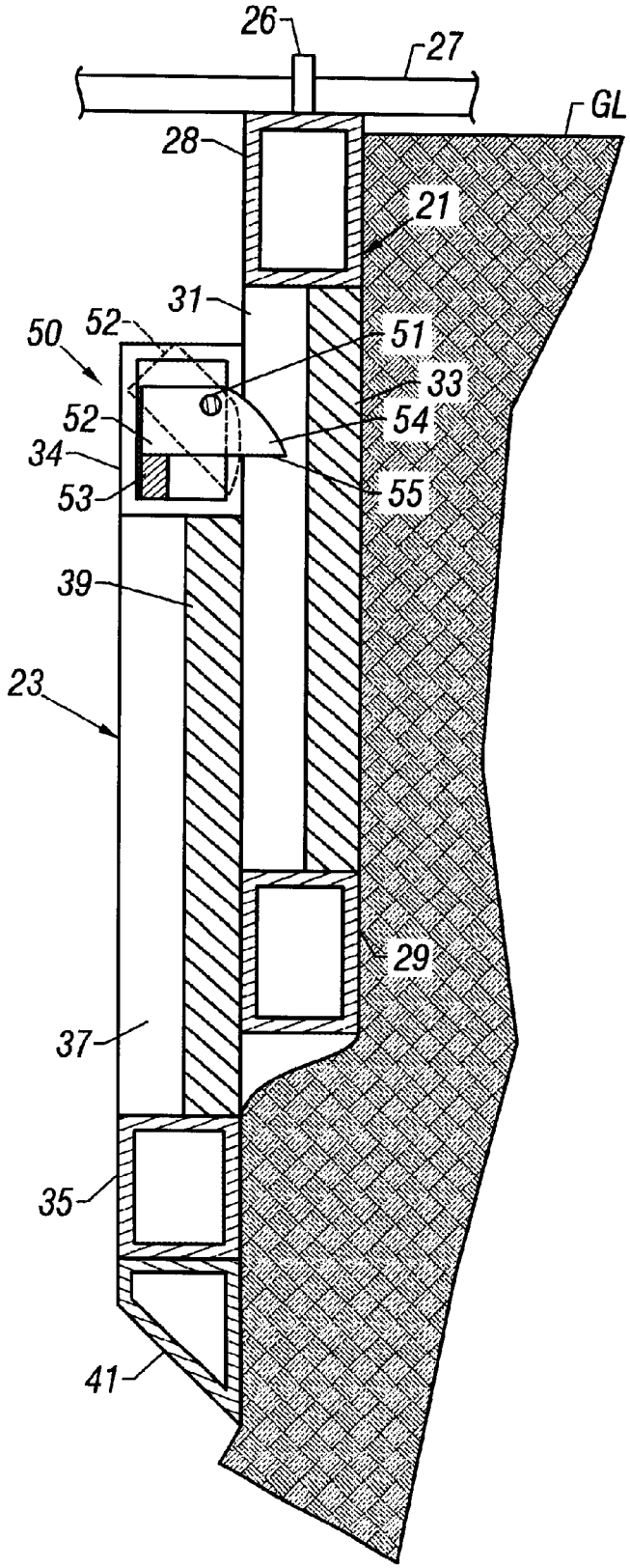
FIG. 12 is a partial cross-sectional view of the embodiment shown in FIG. 11 taken along line A—A, in which a stopping device is shown affixed to an inner panel.

FIG. 12 is a cross-section diagram showing the cross-section A-A in FIG. 11. The shoring system according to this embodiment includes stopping devices 50 to stop the inner panels 23, when sliding down with respect to the outer panels 21, from sliding down further than a desired or necessary point, so that the overlap of the lower portion of the outer panels 21 and the upper portion of the inner panels 23 does not go below a specified, desired, or necessary point.

Figure 13:
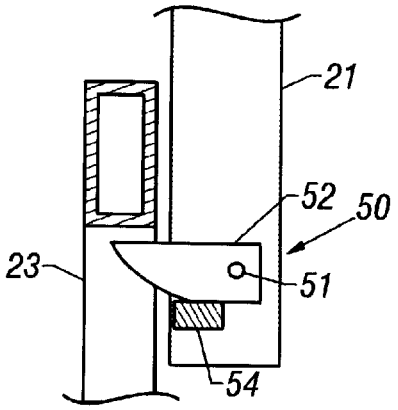
FIG. 13 is a detailed side view of a stopping device affixed to an outer panel.

Referring now to FIGS. 12 and 13, stopping devices 50 are fixed, for example, inside the upper frames of the inner panels 23. A stopping device includes a pivot pin 51 that acts as a supporting axis, a pendulum latch 52 which swings freely around the pivot pin 51, and a stopper 53 which limits the movement of the pendulum latch 52 to a specified position. The pendulum latch is upheld by and swings freely around the pivot pin 51, the position of which is separated from the position of the center of gravity of the pendulum latch 52. In its natural state, the pendulum latch 52 will, under the force of gravity, swing such that the bottom left corner of the pendulum latch 52 as shown in the diagram will descend. The swinging of the pendulum latch 52 in this direction is limited by the stopper 53. In other words, the stopper 53 stops the pendulum latch 52 in the position shown drawn in continuous lines in FIG. 12. In this position, part of the pendulum latch 52 protrudes out of the inner panel 23, or to be more detailed, out of the surface of the upper frame which is facing the outer panel 21, and protrudes towards the outer panel 21. In this position, the bottom surface 55 of this protruding section 54 is approximately horizontal. Consequently, if the inner panel 23 slides down with respect to the outer panel 21, the bottom surface 55 of the pendulum latch 52 will hit the upper edge of the lower frame 29 of the outer panel 21, and the inner panel 23 will not be able to slide down further from there.

On the other hand, when the inner panel 23 slides up with respect to the outer panel 21, even if the protruding section 54 of the pendulum latch 52 hits the upper frame 28 of the outer panel 21, the inner panel 23 will still be able to continue sliding upward. The reason for this is that the pendulum latch 52 swings freely around the pivot pin 51, and there is nothing to stop the clockwise rotation of the pendulum latch 52 as shown in FIG. 12. Consequently, even if the protruding section 54 of the pendulum latch 52 hits the upper frame 28 of the outer panel 21, if the inner panel 23 is made to slide upward, the pendulum latch 52 will take the position shown drawn in dashed lines in FIG. 12, and the inner panel 23 can be lifted up out of the outer panel 21.

Using the same principle, when fitting the outer panels 21 to the inner panels assembly 22, if the outer panels 21 are allowed to slide in from above onto the inner panels 23, the pendulum latches 52 will not hinder the sliding in, so the outer panels 21 and the inner panels 23 can be assembled together in this way.

The upper sides of the pendulum latches 52 that protrude out towards the outer panels 21 are made to taper down towards the tip that protrudes out, to facilitate the swinging of the pendulum latches 52 when these upper sides hit against the upper frames 28.

When the position of the upper frames 34 of the inner panels 23 is in between the upper frames 28 and the lower frames 29 of the outer panels 21, the pendulum latches 52, under the force of gravity, take the position shown drawn in continuous lines in FIG. 12. Consequently, when the outer panels 21 and the inner panels 23 are assembled, the stopping device 50 automatically functions to stop the inner panels 23 from dropping out downwards with respect to the outer panels 21.

The assembly shown in FIG. 12 shows an example in which the stopping device 50 is fixed to the inner panels 23 but, as shown in FIG. 13, the stopping device 50 can also be fixed to the outer panels 21.

The pendulum latch 52 of the stopping device 50 is not to be limited in shape to that shown in the diagrams, but can be any shape as long as a section of the protruding section 54 functions successfully in stopping the inner panels 23 from sliding out downwards with respect to the outer panels 21.

In the explanations above, it has been described that the sliding is stopped when the protruding section 54 of the pendulum latch 52 hits the frames, but the overlap of the outer panels 21 and the inner panels 23 can be adjusted by the installation, at an arbitrary position away from the frames, of a fixture with a surface for the protruding section 54 of the pendulum latch 52 to hit and stop the sliding.

Figure 14:
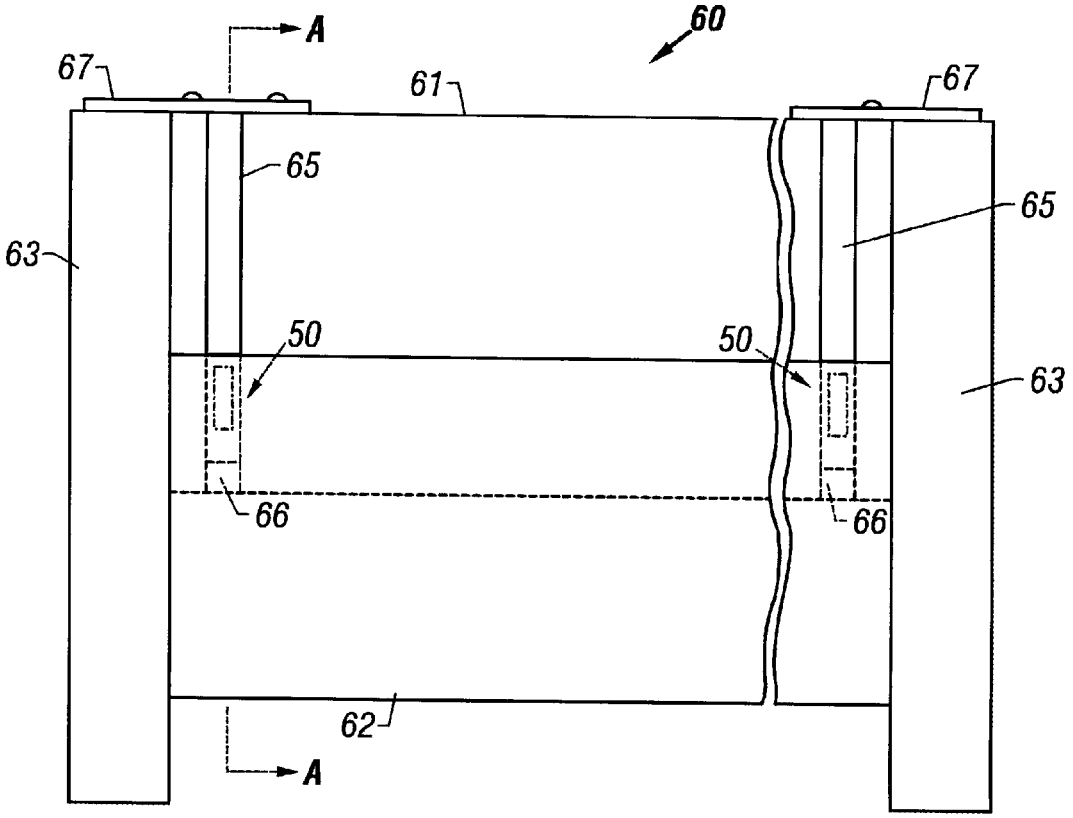
FIG. 14 is a front view of another embodiment of the shoring system of the present invention.
Figure 15:
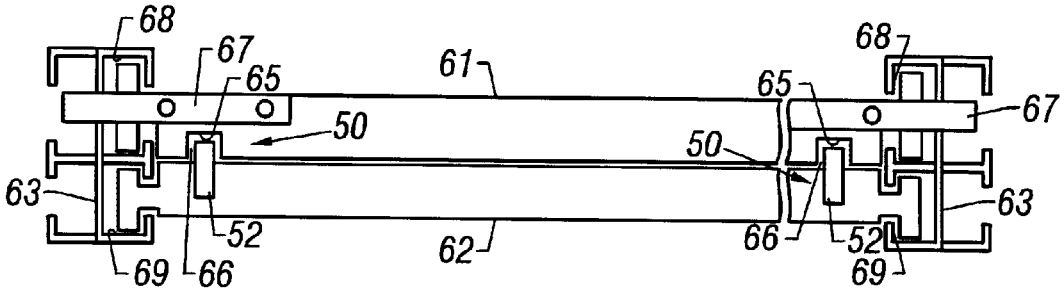
FIG. 15 is a top view and partial cross-sectional view of the shoring system shown in FIG. 14.
Figure 16:
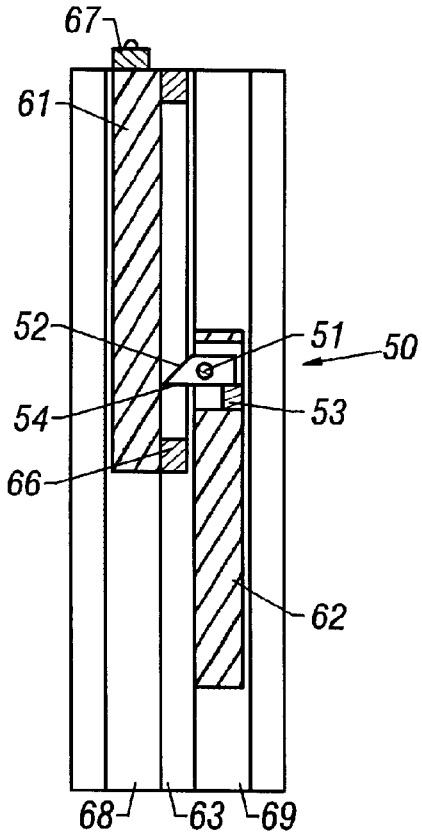
FIG. 16 is a cross-sectional view of the embodiment shown in FIG. 14 taken along line A-A.

Referring now to FIGS. 14–16, FIG. 14 is a front-view diagram of another embodiment of a shoring system according to this invention, FIG. 15 is a plane figure (top-view partial cross-section) diagram of the same, and FIG. 16 is a cross section diagram showing the cross-section A-A from FIG. 14.

Using FIGS. 14–16 as a reference, this shoring system 60 includes two panels 61 and 62. Panel 61 is an outer panel that is positioned in the upper portion within a trench, and panel 62 is an inner panel that slides downward within a trench. The panels 61 and 62 are guided at both ends by double rails 63 and are able to slide vertically.

Vertical guiding grooves 65 are set on the inward-facing surface (the surface that faces the inner panel 62) of the outer panel 61. The guiding grooves 65 are shown set on the left and right ends of the outer panels 61 but, alternatively, just one guiding groove may be set at either end, or set vertically at the center of outer panel 61.

Collision pieces 66 are set at the bottom sections of the guiding grooves 65.

Stopping devices 50, that correspond with the guiding grooves 65, are fixed to the outward facing surface (the surface that faces the outer panel 61) of the inner panel 62. This stopping device 50 is constructed similarly to the one described with reference to FIG. 12. In other words, the stopping device 50 includes a pendulum latch 52 which swings freely around the pivot pin 51, and a stopper 53 which limits the swinging movement of the pendulum latch 52 to a specified position. The pendulum latch is upheld by and swings freely around the pivot pin 51, the position of which is separated from the position of the center of gravity of the pendulum latch 52. In its natural state, the pendulum latch 52 will, under the force of gravity, swing such that the bottom right corner of the pendulum latch 52 as shown in FIG. 16 will descend. The swinging of the pendulum latch 52 in this direction is limited by the stopper 53.

Part of the pendulum latch 52 protrudes out into the guiding grooves 65 that are fixed to the outer panel 61, and the bottom surface of this protruding section 54 is approximately horizontal. Consequently, as shown in FIG. 16, if the inner panel 62 slides downward with respect to the outer panel 61, the protruding section 54 of the pendulum latch 52 will hit the collision pieces 66 and the inner panel 62 will not be able to slide down further from there, with respect to the outer panel 61.

When fitting the inner panels 62 to the outer panels 61, if the inner panels 62 are allowed to slide in from under, the pendulum latches 52 will swing counter-clockwise, with reference to FIG. 16, and will not hinder the sliding in, so the inner panels 62 can be assembled to the outer panels 61. In this way, the stopping device 50 can be applied to conventional double slide rails using slide panels 61 and 62.

Accordingly, when, for example, two panels slide vertically to the specified position, the protruding section of the pendulum latch 52 will hit the collision piece 66 and both panels will not be able to slide any further. Therefore, if two panels are allowed to slide to form shoring walls, for example the lower panel will not sink too much in the trench with respect to the upper panel, thus making the job safe and simple. Further, a pendulum latch 52 is rotated by its own weight or an energizing force generated by an elastic energizing means including rubber and spring, so that a part of the pendulum latch 52 projects out towards the side in which the collision piece 66 is set, therefore eliminating the risk of forgetting to operate a device to stop the sliding. Therefore, if two panels slide along double slide rails, then the stopping device 50, which consists of a pendulum latch 52 and a stopper 53, will function properly, thereby reliably stopping the sliding at a specified position.

As further illustrated in FIGS. 14–16, suspension plates 67, which project into the left and right of the outer panels 61, are secured at the upper ends of the outer panels 61. Suspension plates 67 are installed so that, when the outer panels 61 are inserted onto and slid along the double slide rails 63, the outer panels 61 are prevented from sliding downwards any further than the point at which the upper ends of the outer panels 61 coincide with the upper end of the double slide rails 63.

As shown in FIG. 15, two parallel grooves 68 and 69 are formed in the double slide rails 63. The outer panels 61 are inserted at the left and right ends into groove 68 and slide along groove 68. The inner panels 62 are inserted at the left and right ends into groove 69 and slide along groove 69. The description above describes an example in which stopping devices 50 are fixed to the inner panels 62 but, as described earlier in FIG. 13, the stopping devices 50 may also be fixed to the outer panels 61 in which case the collision pieces 66 are fixed to the inner panels 62.

The stopping device 50 is described designed so that the protruding section 54 of the pendulum latch 52 hits the collision pieces 66 attached to the outer panels 61 but, alternatively, can be designed so that the protruding section 54 of the pendulum latch 52 hits collision pieces located in the double slide rails 63. In that event, the sliding positions of the inner panels 62 can be limited in relation to the double slide rails 63 instead of in relation to the outer panels 61. In this case, the sliding positions of the outer panels 61 with respect to the double slide rails 63 are limited by the suspension plates 67 so, in the end, even in this case, the positions of the outer panels 61 and the inner panels 62 in relation to each other can be limited such that they do not slide further than the point in which the overlap is within a specified, desired, or necessary position.

Also, stopping devices 50 which contain pendulum latches 52 can be fixed to the double slide rails 63, so that the protruding section 54 of the pendulum latch 52 stops the sliding of the panels (applicable to inner panels 62 and outer panels 61) when they slide to the specified position with respect to the double slide rails 63.

Also, in the description above of the stopping device 50, it is described that the pendulum latch 52 rotates by its own weight but the stopping device 50 can, alteratively, also be designed such that an elastic energizing means such as rubber or spring is provided that will generate an energizing force to always rotate the pendulum latch 52 to a specified position. In this case, the pivot pin 51 can be in an arbitrary position as a supporting axis to the pendulum latch 52.

This invention is not to be limited to all the forms of application described above, but is modifiable in various ways within the category of the claims. It is to be understood that the invention is not limited to the exact details of construction, operation, exact materials, or embodiments shown and described, as obvious modifications and equivalents will be apparent to one skilled in the art. Accordingly, the invention is therefore to be limited only by the scope of the appended claims.

What is claimed:

1. A trench shoring system for preventing possible falling of natural ground walls of trenches, comprising:

a pair of outer panels, each outer panel having inner and outer wall surfaces and upper and lower portions;

a pair of inner panels, each inner panel having inner and outer wall surfaces and upper and lower portions, the pair of inner panels being coupled together by at least one inner panel strut, one pair of panels being disposed for vertical sliding movement along a wall surface of the other pair of panels; and at least one stopping member associated with at least one of the pairs of panels for preventing one of the pairs of panels from sliding past a desired position with respect to the other pair of panels, whereby the lower portions of one of the pairs of panels and the upper portions of the other pair of panels are connected together forming a single unit trench shoring system that can be installed and removed in an entire assembled state.

2. The trench shoring system of claim 1, wherein the at least one inner panel strut that couples together the inner panels is at least two inner panel struts.

3. The trench shoring system of claim 1 or 2, wherein the pair of outer panels are coupled together at the upper portions of the outer panels by at least one outer panel strut thereby providing a space between the pair of outer panels to receive the inner panels.

4. The trench shoring system of claim 3, wherein the pair of inner panels include guides thereby providing vertical sliding movement of the pair of inner panels with respect to the pair of outer panels.

5. The trench shoring system of claim 4, wherein each of the at least one outer panel strut is freely adjustable lengthwise.

6. The trench shoring system of claim 5, wherein the outer panels include a pair of retaining members.

7. The trench shoring system of claim 6, wherein the stopping member includes:

at least one pendulum latch in contact with one of either the inner of the outer pair of panels, and a portion of the pendulum latch defines a projection; and at least one collision piece in contact with the pair of inner panels and contacts the projection when the pair of inner panels slides down to a desired position with respect to the pair of outer panels, thereby preventing the pair of inner panels from sliding down further with respect to the pair of outer panels.

8. The trench shoring system of claim 7, wherein the pendulum latch is swingably supported at a position off from the center of gravity by a supporting axis thereby allowing the pendulum latch to rotate by the weight of the pendulum latch, and includes a stopper that limits the rotation of the pendulum latch so that the pendulum latch stops with a portion thereof projecting from one of the pairs of panels.

9. The trench shoring system of claim 3, wherein the pair of outer panels include guides thereby providing vertical sliding movement of the pair of outer panels with respect to the pair of inner panels.

10. The trench shoring system of claim 6, wherein the stopping member includes:

at least one pendulum latch in contact with one of the pairs of panels, and a portion of the pendulum latch defines a projection; and at least one collision piece in contact with the pair of outer panels and contacts the projection when the pair of outer panels slides down to a desired position with respect to the pair of inner panels, thereby preventing the pair of outer panels from sliding down further with respect to the pair of inner panels.

11. The trench shoring system of claim 7, wherein the pendulum latch is swingably supported by a supporting axis, and includes an elastic energizing means thereby enabling the pendulum latch to rotate until a portion of the pendulum latch projects from one of the pairs of panels, and a stopper thereby limiting the rotation of the pendulum latch.

12. A set of trench shoring panels comprising:

two panels disposed for vertical sliding movement with respect to each other thereby providing shoring walls;

at least one pendulum latch contacting one of the two panels, wherein a portion of the pendulum latch defines a projection; and at least one collision piece on the other panel which contacts the projection of the pendulum latch when the two panels slide to a desired position with respect to each other.

13. The set of trench shoring panels of claim 12, including double slide rails having two parallel grooves, the two panels disposed for sliding movement of the two panels with respect to each other within the grooves.

* * * * *